US005311815A

United States Patent [19]

Ijichi

[11] Patent Number: 5,311,815

[45] Date of Patent: May 17, 1994

[54] INK FEEDING DEVICE FOR A PRINTING PRESS

[75] Inventor: Yuji Ijichi, Hidaka, Japan

[73] Assignee: Rockwell International Corporation, El Segundo, Calif.

[21] Appl. No.: 907,967

[22] Filed: Jul. 2, 1992

[30] Foreign Application Priority Data

Jul. 23, 1991 [JP] Japan ..... 3-65116[U]

[51] Int. Cl.[5] ..... B41F 31/06; B41L 27/08

[52] U.S. Cl. ..... 101/350

[58] Field of Search ..... 101/350, 349, 364, 363, 101/148, 207, 208, 209, 210

[56] References Cited

U.S. PATENT DOCUMENTS 4,414,897 11/1983 Sato et al. ..... 101/350

5,144,892 9/1992 Tupek et al. ..... 101/DIG. 34

*Primary Examiner*—J. Reed Fisher

*Attorney, Agent, or Firm*—C. B. Patti; H. F. Hamann

[57] ABSTRACT

An ink feeding device (12) for a printing press (10) having an ink pan (40) having a cavity (42) to receive and retain ink, a rotatable fountain roller (14) mounted in the cavity (42) of the pan (40), a device (28) for rotating the fountain roller (14), a rotatable metering roller (16) positioned to receive ink from the fountain roller (14), a device (30) for rotating the metering roller (16), a doctor blade (50) for removing residual ink from the metering roller (16), a rotatable impeller (44) mounted on one side of the fountain roller (14) in the cavity (42) of the pan (40) generally below the doctor blade (50) and having a plurality of blades (46) to direct ink returned by the doctor blade (50) towards the fountain roller (14), and a device (48) for rotating the impeller (44).

3 Claims, 1 Drawing Sheet

INK FEEDING DEVICE FOR A PRINTING PRESS

CROSS-REFERENCE TO RELATED APPLICATION

The applicant claims priority of Japanese application Heisei 3-65116 (SU-0695), filed in Japan on Jul. 23, 1991, incorporated herein by reference.

BACKGROUND OF THE INVENTION

The present invention relate to feeding devices for printing presses.

In the past, offset printing presses have been provided having a plurality of rollers for printing ink on a paper web. Such presses have a delivery system for placing ink on the rollers, and a delivery system for also placing a dampening solution on the rollers. Prior systems of this sort, in the case of the ink delivery systems, have required complicated devices which include a storage tank for the ink, a conduit from the tank to the vicinity of one of the rollers to place the ink on the roller, and a pump to drive the ink through the conduit to the roller. In addition, it has been difficult to use hard ink in such presses.

SUMMARY OF THE INVENTION

A principal feature of the invention is the provision of an improved ink feeding device of simplified construction.

The ink feeding device of the present invention comprises, an ink pan having a cavity to receive and retain ink, a rotatable fountain roller mounted in the cavity of the pan, means for rotating the fountain roller, a rotatable metering roller positioned to receive ink from the fountain roller, means for rotating the metering roller, a doctor blade for removing residual ink from the metering roller, and a rotatable impeller mounted on one side of the fountain roller in the cavity of the pan generally below the doctor blade, and means for rotating the impeller.

A feature of the invention is that the impeller has a plurality of blades to direct ink returned by the doctor blade towards the fountain roller.

Another feature of the invention is that the ink is positively driven towards the fountain roller for pick up without the necessity of a storage tank or pump.

Thus, a feature of the invention is that the device is of simplified structure and reduced cost.

Another feature of the invention is that relatively hard ink may be utilized in the device.

A further feature of the invention is that the fountain roller may be driven at a lower rotational speed than the metering roller in order to pull and stretch the ink and improve its fluidity, and the ink film on the fountain roller is pulled and stretched on the surface of the metering roller such that it is transferred as a relatively thin ink film on the metering roller.

A feature of the invention is that the ink is constantly being circulated, and does not become stagnant.

A further feature of the invention is that the ink is thoroughly mixed with the dampening solution in the device of the present invention.

Still another feature of the invention is that the device reduces the ink volume required for circulation of the ink.

Yet another feature of the invention is that the device provides an improved quality of printed product.

Further features will become more fully apparent in the following description of the embodiments of this invention, and from the appended claims.

DESCRIPTION OF THE PREFERRED EMBODIMENTS

Figure 1:
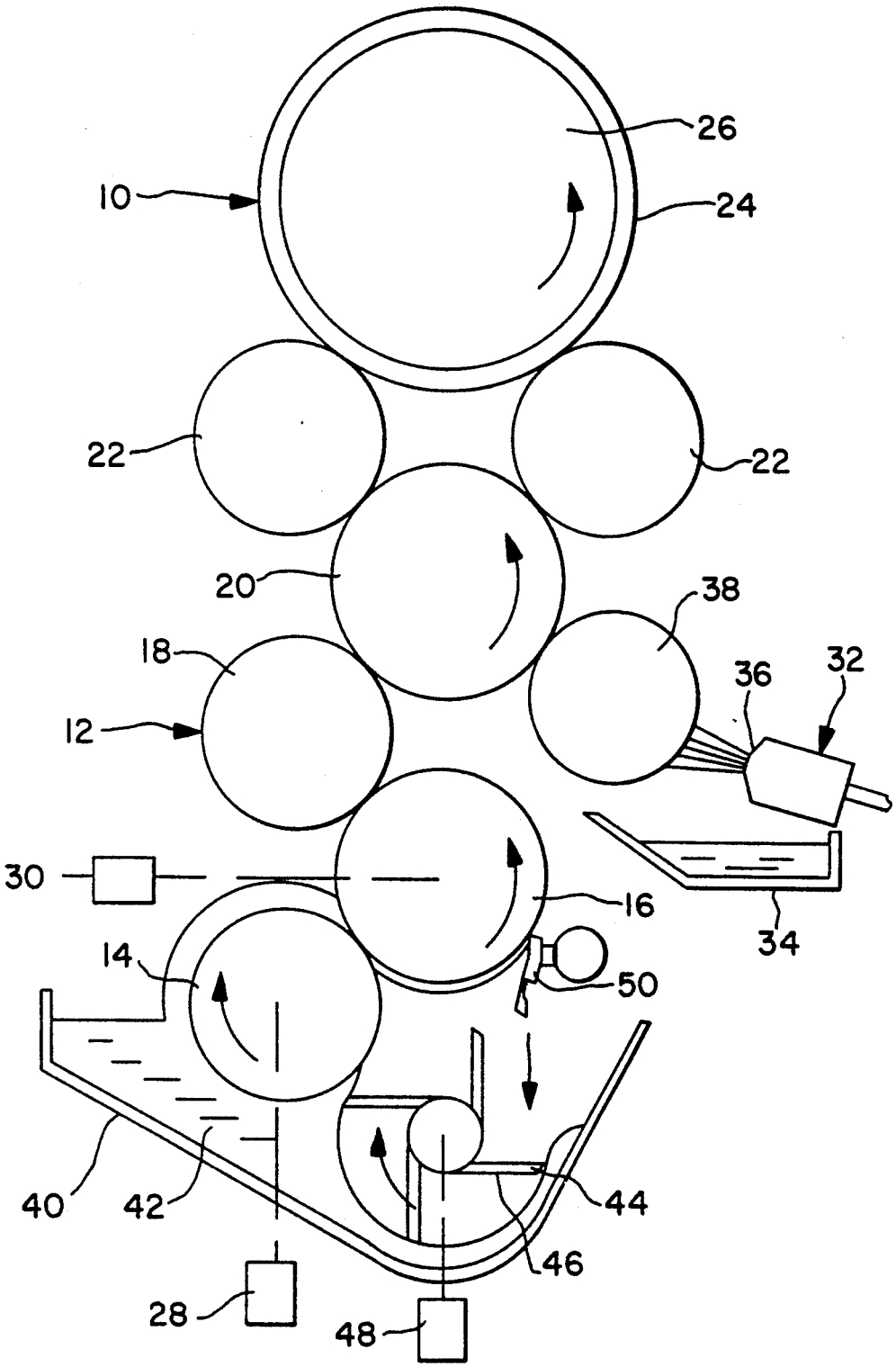
FIG. 1 is a diagrammatic view of an ink feeding device for a printing press of the present invention.

Referring now to FIG. 1, there is shown a printing press generally designated 10 having an ink feeding device generally designated 12. The press 10 has a rotatable fountain roller 14 to receive and place ink on a rotatable metering roller 16. The ink passes from the metering roller 16 onto a rotatable bridging roller 18 and subsequently to a rotatable ink drum 20. An ink and water coating on the ink drum 20 then passes to a pair of rotatable ink brushing rollers 22 to a printing plate 24 mounted on a rotatable plate cylinder 26 for subsequent printing on a paper web. The press 10 may have a first motor 28 for rotatably driving the fountain roller 14, and a second motor 30 for driving the metering roller 16 and the remaining rollers 18, 20, 22, and 26 at the same rotational speed. It is preferred that the fountain roller 14 be driven at a lower rotational speed than the metering roller 16 for a purpose which will be described below.

The printing press 10 has a water or dampening solution supplying device generally designated 32 having a pan 34 for retaining a supply of water, and a nozzle 36 for spraying the water on the outer surface of a rotatable dampener roller 38. The water then passes from the dampener roller 38 onto the ink drum 20 for subsequent passage to the ink brushing rollers 22 and plate cylinder 26 along with the ink. In a preferred form, the dampener roller 38 is rotatably driven by the second motor 30 at the same rotational speed as the ink drum 20 and other rollers driven by the second motor 30.

The ink feeding device 12 has pan member or pan 40 having a cavity 42 to receive and retain ink, with the fountain roller 14 being rotatably mounted in the cavity 42 of the pan 40, and with the metering roller 16 being rotatably mounted above the pan cavity 42.

The ink feeding device 12 also has a rotatable impeller 44 located on one side of the fountain roller 14 in the cavity 42 of the pan 40. As shown, the impeller 44 has a plurality of outwardly extending blades 46, and the impeller 44 is rotatably driven by a third motor 48 in a clockwise direction in order to move collected ink towards the fountain roller 14.

As shown, the ink feeding device 12 also has a doctor blade 50 to remove residual ink from the metering roller 16 which falls below the doctor blade 50 into the cavity 42 of the pan 40. In a preferred form, the impeller 44 is located generally beneath the metering roller 16 and doctor blade 50, such that the removed residual ink passes directly towards the impeller 44.

In turn, the rotating impeller 44 drives the collected ink in the cavity 42 towards the fountain roller 14 where the ink gathers to form a relatively thick film of ink circumferentially around the fountain roller 14. As previously indicated, the metering roller 16 is rotated at a greater speed than the fountain roller 14 such that the film of ink on the fountain roller 14 is pulled and stretched on the surface of the metering roller 16 in order to form a relatively thin film of ink on the metering roller 16.

The ink collected in the cavity 42 of the pan 40 is thus directly driven towards the fountain roller 14 by the impeller 44 such that the ink gathers against the outer surface of the fountain roller 14 and adheres to its surface for subsequent passage to the metering roller 16. Thus, the amount of ink collected in the pan 40 may be greatly reduced from those of prior art circulating tanks, and the ink in the pan 40 is constantly circulated, such that it does not become stagnant. In addition, the water and ink becomes more mixed by the impeller, and a relatively hard ink may be used in the device 12 which increases its fluidity. Further, the ink feeding device 12 is of simplified construction and reduced cost, and the circulation of the ink in the device is also improved to provide an improved printed copy by the printing press 10.

The foregoing detailed description has been given for clearness of understanding only, and no unnecessary limitations should be understood therefrom, as modifications will be obvious to those skilled in the art.

What is claimed is:

1. An ink feeding device for a printing press, comprising:

an ink pan having a cavity to receive and retain ink;

a rotatable fountain roller mounted in the cavity of the pan;

means for rotating the fountain roller;

a rotatable metering roller positioned to receive ink from the fountain roller;

means for rotating the metering roller;

a doctor blade for removing residual ink from the metering roller;

a rotatable impeller mounted on one side of the fountain roller in the cavity of the pan generally below the doctor blade and having a plurality of blades to direct ink returned by the doctor blade towards the fountain roller, said impeller being only partially submerged in the ink in the cavity of said pan; and means for rotating the impeller.

2. The device of claim 1 wherein the fountain roller is mounted on one side of the doctor blade and impeller, and in which the rotation of direction of the impeller is selected to drive ink towards the fountain roller.

3. The device of claim 1 wherein the rotating means rotates the metering roller at a greater rotational speed than the fountain roller.

* * * * *